United States Patent [19]

Guy

[11] Patent Number: 4,588,300

[45] Date of Patent: May 13, 1986

[54] VIBRATOR ASSEMBLY

[75] Inventor: Jimmy R. Guy, Houston, Tex.

[73] Assignee: American Precision Vibrator Co., Houston, Tex.

[21] Appl. No.: 614,994

[22] Filed: May 29, 1984

[51] Int. Cl.[4] ..... B01F 11/00

[52] U.S. Cl. ..... 366/114; 366/124

[58] Field of Search ..... 74/86, 87; 173/128, 173/132, 133; 366/114, 120, 124, 125, 126; 405/232

[56] References Cited

U.S. PATENT DOCUMENTS 3,731,907 5/1973 Lash ..... 366/114

4,083,415 4/1978 Kita ..... 173/132

4,129,388 12/1978 McKee ..... 366/124

*Primary Examiner*—Timothy F. Simone

*Attorney, Agent, or Firm*—Carwell & Helmreich

[57] ABSTRACT

An impact vibrator for electrostatic precipitators and the like having a vibrator means interconnected in coaxial alignment with a mounting means adapted to receive a conventional rod member, the mounting means being interconnected to the vibrator whereby relative movement therebetween is restricted in the axial direction while permitting relative rotational movement therebetween about the axis. In a preferred embodiment, the vibrating piston disposed within the vibrator means directly engages a portion of the mounting means also disposed within the vibrator during the impact stroke.

17 Claims, 9 Drawing Figures

FIG. 1
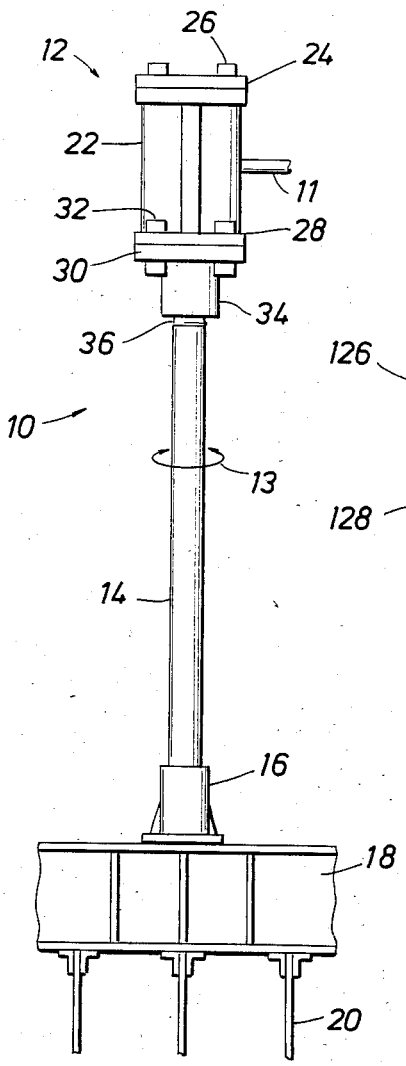
FIG. 4A
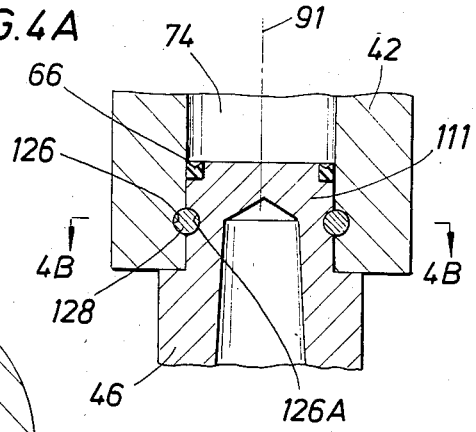
FIG. 4B
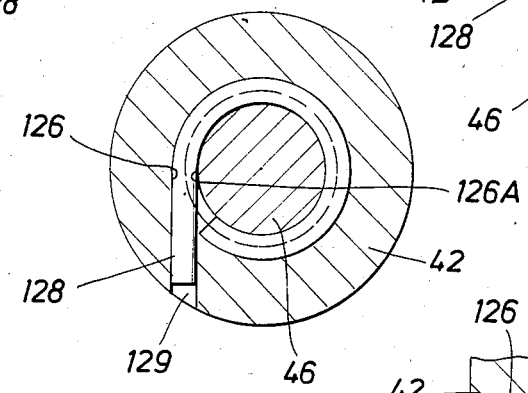
FIG. 4C
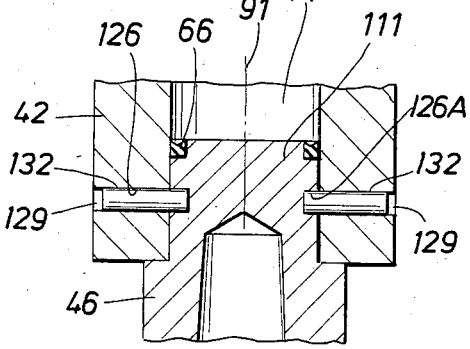
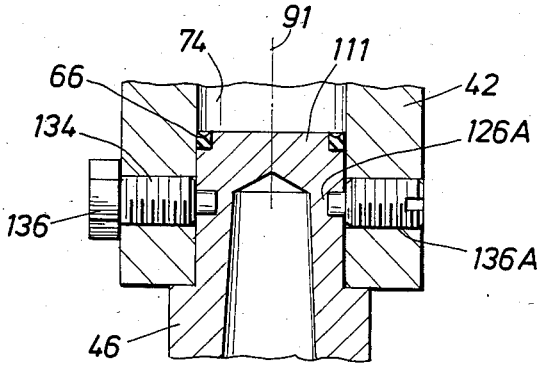
FIG. 4D
FIG. 4E
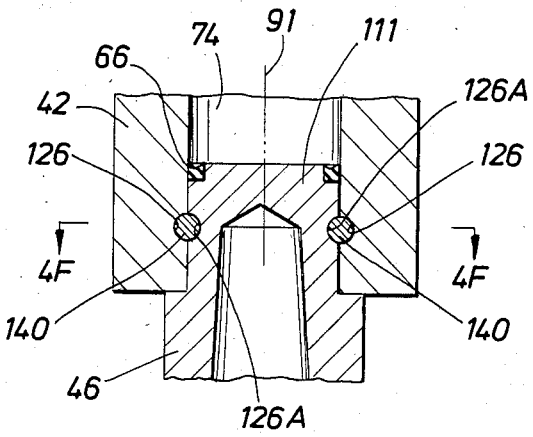
FIG. 4F
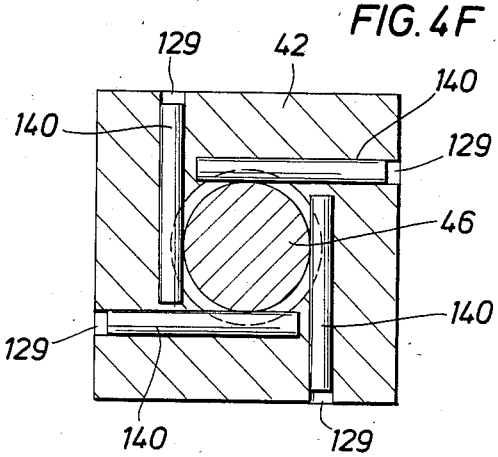

VIBRATOR ASSEMBLY

BACKGROUND OF THE INVENTION

1. Field of the Invention

The present invention relates to vibrators, and in particular to unidirectional impact vibrators of the pneumatic type.

2. Prior Art

Impact vibrators employing a pneumatically actuated piston have found wide use in industry for knocking off accumulations on electrostatic precipitator plates and wires, for deslagging boilers, knocking dust or other accumulations off of surfaces such as in bin hopper applications, and the like. A representative example of such vibrators may be seen depicted in U.S. Pat. No. 3,731,907 entitled "Vibrator System" and issued to Lash.

With reference to FIG. 1, typically such vibrator assemblies as assembly 12 depicted therein are employed as a vibrator-rod assembly 10 wherein the vibrator assembly 12 is interconnected by means of a tapered sleeve mount 34 to a tapered end 36 of an elongate rod member 14, the distal end of which is in turn inserted in a rod socket 16 which is integrally attached to an anvil 18 which is to be vibrated. The anvil 18 will also typically have, in the application depicted, a plurality of precipitator plates 20 or the like which, in a given plant process, may have accumulated thereon undesirable deposits which must be vibrated free.

In operation of the vibrator-rod assembly 10, a source of pressurized fluid is introduced into a pneumatic port 11 into the piston chamber or annulus of the vibrator body 22. Referring more particularly to the vibrator assembly 12 itself, such assemblies will be conventionally comprised of the body 22 forming the aforementioned annulus in which a piston (not shown) vibrates up and down in response to the charge from the port 11. The annulus is sealed above the piston by means of a cap 24 which is interconnected to the body 22 by means of bolts 26. In like manner, the tapered mount 34 having a lower base plate 30 is interconnected to an upper base plate 28 by means of bolts 32. The mount 34 includes a tapered sleeve therein which matingly engages a corresponding tapered end 36 of the rod member 14. It is conventional to provide such a mount 34 - body 22 assembly in a two piece construction whereby the mount 34 may be conveniently replaced with another mount having a different taper adapted to receive the tapered end 36 of the particular rod member 14 encountered in a given application.

Once the vibrator assembly 12 has been operating for a short period of time the press fit between the internal bore of the mount 34 and the end 36 will be such that little if any relative rotational movement in the direction of arrow 13 will be experienced between rod member 14 and mount 34 due to the tremendous longitudinal forces exerted upon the rod 14 by the vibrator assembly 12.

A very serious problem has been experienced with the particular vibrator construction of FIG. 1. Whereas the primary force generated by the vibrator 12 and transmitted through rod member 14 to anvil 18 is in the downward direction, it has been found that there is frequently also a torsional component of force transmitted from the vibrator 12 through rod 14 often of a magnitude such that over a period of prolonged use damage occurs to the vibrator-rod assembly 10 in the vicinity of the rod socket 16, either by the socket 16 itself breaking free of the anvil 18, or the like. It has been thought that this phenomenon may be due to a rotational force imparted upon the vibrator assembly 12 by the pressurized fluid injected therein at the pneumatic port 11.

Not only has damage been encountered in the area adjacent rod socket 16, but it has also been found that damage occurs at the interface between base plates 28 and 30, either by way of bolts 32 fatiguing, or shearing, deterioration of gaskets and seals between the plates, or the like.

Accordingly, numerous attempts have been made to overcome these problems. One such approach has been to provide a one piece construction such as that depicted in the aforementioned U.S. Pat. No. 3,731,907. However, such construction while alleviating problems at the situs of the base plate interface nevertheless did not attack the fundamental problem in that torsional forces were still being transmitted from the vibrator assembly 12 to the rod member 14 or any other article attached to the mount 34. In many applications the resulting necessary repairs could become extremely expensive and time consuming involving the total shut down of processing plants while rod members or sockets are replaced or repaired and the like.

Yet another problem in the installation of such vibrator assemblies 12, is that due to the weight and taper thereof, once the assembly 12 is placed upon a rod member 14, it is extremely difficult and cumbersome to rotate the vibrator assembly 12 about the longitudinal axis of rod 14 and assembly 12. Such deficiency frequently becomes troublesome in installations and repair due to limitations on length and positioning of the pneumatic tubes connecting to the port 11. For example, it may be desirable to rotate the vibrator assembly 12 to a position where the connector to the pneumatic port 11 may be more readily accessible for repair of the assembly 12, for routing shorter pneumatic tubes to the port 11, or the like. Yet, in conventional designs once the assembly 12 was positioned on the workpiece, such re-positioning was rendered extremely difficult if not impossible.

Still a further serious problem associated with vibrator assemblies of a conventional design is that a great deal of the energy developed by the piston which is intended to be transferred to the article to be vibrated is lost in the housing or body of the vibrator assembly itself. This was thought to be due, in part, to the fact that the piston was typically made to impact directly against an internal portion of the vibrator body itself which absorbed much of the energy.

The housing was, in turn, attached to a mounting means which mounted the vibrator to the article to be vibrated. Thus, while vibrating energy was transferred from the housing or body through the mount to the article, much of the initial energy of the piston was lost in the mass of the body, as aforesaid. Thus, a vibrator design was long sought after which could effect more efficient energy transfer from the piston to the article itself.

SUMMARY OF THE INVENTION

It is therefore an object of the present invention to provide an improved vibrator assembly of the unidirectional impact type.

Another object of the present invention is to provide an improved vibrator assembly readily mountable to a variety of articles to be vibrated wherein means are provided for reducing the torque transmitted from the vibrator assembly to the article.

Still another object of the present invention is to provide an improved vibrator assembly wherein the assembly may be readily free to rotate about its longitudinal axis relative to the article to which it is attached.

Yet another object of the present invention is to improve the transfer of impacting energy transmitted from the piston of a vibrator assembly to the article to be vibrated.

The above and other objects of the present invention will become apparent from the drawings, the description given herein, and the appended claims.

In a preferred embodiment, the invention pertains to an unidirectional vibrator assembly of the impact type for providing linear impact forces to articles to be vibrated such as electrostatic precipitators and the like wherein the torsional forces are substantially reduced and the transfer of energy from the vibrator to the article is improved.

A vibrator means is provided for generating a force along the longitudinal axis thereof in response to a pressurized fluid introduced into the vibrator means. A mounting means is interconnected between the vibrator means and the desired article and is provided for mounting the vibrator assembly to the article. In one form, the mounting means includes a tapered bore therein adapted to receive a mating end of a rod interconnected to the article to be vibrated. In another form, the mounting means may alternatively take the form of a mounting plate to be bolted or welded to the article to be vibrated.

In either form, the mounting means includes an end portion which extends into an annulus defined by the vibrator means. A retainer means is interconnected between the vibrator means and the mounting means for permitting rotational motion of the vibrator means relative to the mounting means about a longitudinal axis common to the vibrator means and the mounting means while restricting relative motion between the mounting means and the vibrator means in the direction of the axis.

The vibrator means includes a piston movable within the annulus and along the axis in response to a pressurized fluid introduced into the annulus, the piston having a piston base at one end. The portion of the mounting means disposed within the annulus defines a mounting base which is matingly engagable with the piston base upon movement of the piston toward the mounting means. In this manner, impacting energy is transmitted directly to the mounting means from the piston thus improving the energy transfer to the article to be vibrated. This is to be contrasted with conventional vibrator apparatus whereby significant energy is lost to the vibrator means and in particular to the vibrator housing or body from the piston due to the piston contacting the housing or body directly.

In an alternate embodiment, an anvil divides the annulus within the vibrator means into first and second chambers, the first chamber of which receives the end portion of the mounting means and the second chamber of which encloses the vibrating piston. In this embodiment, the piston base contacts the upper surface of the anvil of the vibrator means and thus force is delivered from the piston through the anvil to the mounting means. However, as hereinbefore noted, in the first-described and preferred embodiment the force of the piston is delivered directly to the mounting means, thereby desirably increasing the magnitude of the force imparted by the piston to the mounting means and ultimately the article to be vibrated.

With respect to both of the aforementioned embodiments, a first recess is provided in the body of the vibrating means and a second recess provided in the portion of the mount means inside the vibrator means whereby the two recesses may be aligned when the mounting means is partially disposed within the chamber. A retainer member is disposed in a position within the first and second recesses whereby the mounting means and vibrator means may rotate relative to one another about their common longitudinal axis whereas relative linear motion along the axis between the vibrator means and the mounting means is restricted.

In a preferred embodiment of the retainer means, the second recess in the mounting means comprises an arcuate groove extending at least partially about the axis on the outer surface of the portion of the mounting means received within the annulus of the vibrating means. An aperture extends through the vibrator body of the vibrator means which houses the piston, whereby the retainer member may be inserted through the aperture upon alignment of the first and second recesses and thereby disposed in the aforementioned position within the first and second recesses.

The retainer member will thus remain in a stationary position in the first recess interconnected to the aperture and will travel along the arcuate groove of the second recess in registry therewith as the vibrator body and the mounting means are rotated relative to one another relative to their common longitudinal axis. However, because the relative dimensions of the first and second recesses and the retainer member in the direction of the axis are approximately identical, the mounting member is thereby precluded from substantial movement relative to the body of the vibrating member along the direction of the axis. In a preferred embodiment of the invention the retainer member comprises a plurality of balls of the ball bearing type inserted through the aperture of the body of the valve member whereby they may be distributed radially outwards of and about the axis into positions within the first recess which will also desirably comprise an arcuate groove in the body concentric with that of the second groove-like recess.

Several important advantages result from this assembly. Among these are that the rotational torque which otherwise might be imparted to the mounting means and thence to the article attached thereto will be substantially reduced inasmuch as the vibrating member is free to rotate relative to the mounting means about the longitudinal axis common thereto which lies in the direction in which the longitudinal force from the vibrating means to the mounting means is applied. Moreover, such construction permits rotation of the vibrating means relative to the mounting means for purposes of aligning a pneumatic input port in the body of the vibrator means angularly about the axis in any desired fashion, the aforesaid input port delivering the pressurized fluid to the vibrator means for actuating the impacting piston disposed therein. Moreover, in the first embodiment described, increased energy transfer is experienced from the piston to the article to be vibrated due to direct impact of the piston on the mounting means.

BRIEF DESCRIPTION OF THE DRAWINGS

The invention may be more fully understood by reference to the description of a preferred embodiment in conjunction with the drawings, wherein:

FIG. 1 is a pictorial view of a typical application of a vibrator assembly of the prior art.

FIG. 4A is an enlarged fragmentary section of a portion of the vibrating apparatus of the present invention.

FIG. 4B is a top view of the section depicted in FIG. 4A taken along line 4B.

FIG. 4C is another section of the vibrator apparatus of the present invention.

FIG. 4D is still another side view of a section of another embodiment of the present invention.

FIG. 4E is still another side view of a section of another embodiment of the present invention.

FIG. 4F is a top view taken along line 4F of FIG. 4E of another section of another embodiment of the present invention.

DESCRIPTION OF THE PREFERRED EMBODIMENT

Figure 2:
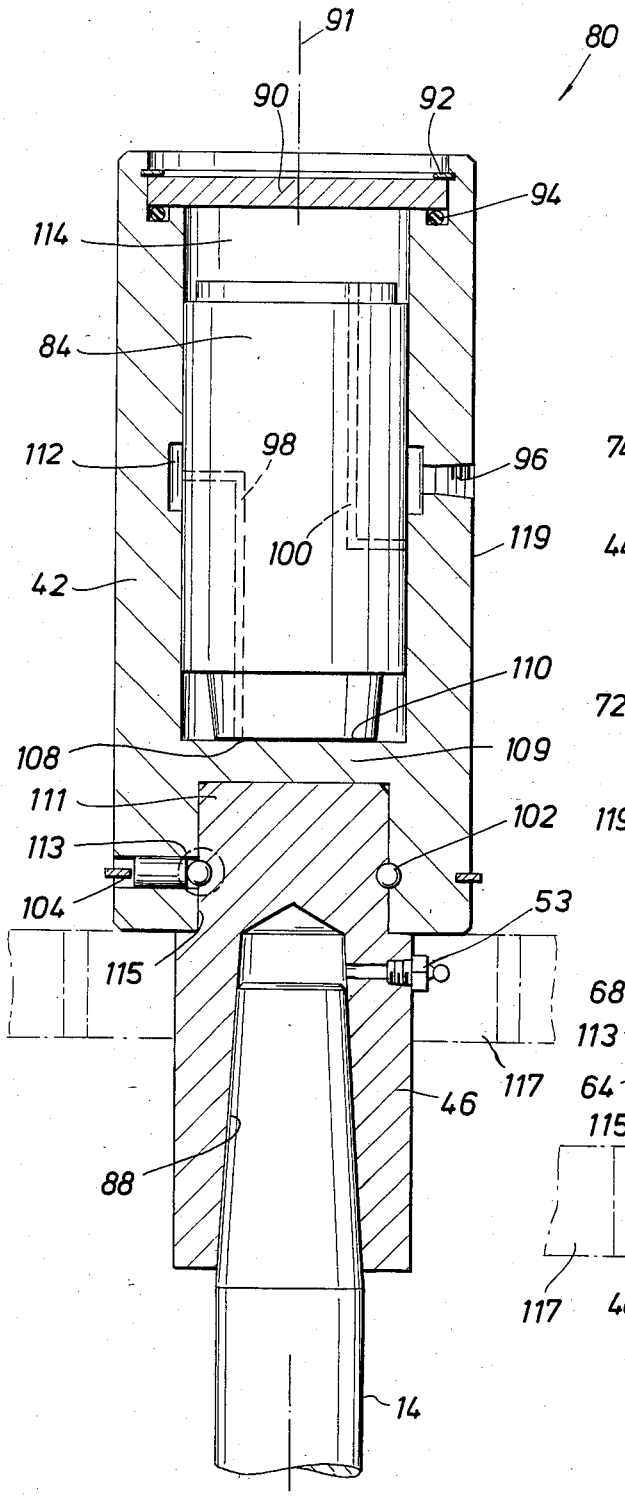
FIG. 2 is a side view, partially in section, depicting a vibrator assembly constructed in accordance with the present invention.

Referring now to FIG. 2, there will be seen depicted therein generally a vibrator assembly 80 of the present invention comprised generally of a vibrator means for generating an unidirectional impacting force and a mounting means 46 interconnected to the vibrating means for delivering this force to the article to be vibrated, and finally a retainer means 113 for interconnecting the mounting means 46 and the vibrator means in a manner to be described in greater detail hereinafter.

Referring more particularly first to the vibrator means, with reference to FIG. 2 there will be seen a vibrator body 42 which defines an annulus 114 machined therethrough. In the embodiment depicted in FIG. 2, the body 42 will include an anvil 109 extending across the annulus 114 whereby the annulus is thereby actually comprised of a first chamber 115 at the lower end of the body 42 and an upper second chamber 114. At the upper end of body 42 the second chamber 114 is sealed off by means of a cap 90, cap retainer 92 and a cap seal 94.

A closer view of FIG. 2 will reveal that a recess 112 is preferably provided in the internal surface of body 42 circumferentially about axis 91 and a threaded port 96 in fluid communication with the recess 112. The port 96 will be seen to correspond to the location in FIG. 1 wherein the pneumatic tube 11 is interconnected, thereby providing pressurized fluid from a convenient location through a pneumatic tube 11 to an appropriate connector threaded into port 96, whereby this pressurized fluid may be delivered into the recess 112.

There will also be seen in FIG. 2 a piston 84 disposed within the second chamber 114. The piston will preferably have a passage 98 extending therethrough which terminates at one end at a location on the outer wall of the piston intermediate of its ends and terminates at its lower end adjacent the piston base 108. In like manner, a second passage 100 is also provided in piston 84 terminating at a location intermediate of the two ends of piston 84 and also terminating adjacent the upper end of piston 84.

With the piston 84 in a lower first position as depicted in FIG. 2 wherein the piston base 108 is adjacent to or contacting the upper anvil surface 110 of anvil 108, it will be noted that the aforementioned termination of passage 98 intermediate of the ends of piston 84 will be in fluid communication with the recess 112. In like manner, when the piston 84 is in a second position (not shown) wherein it is moved upwards in the direction of axis 91 relative to body 42 whereby the upper end of the piston 84 is immediately adjacent the cap 90, it will further be appreciated that the passage 100 will have its end thereof intermediate the opposed ends of piston 84 in fluid communication with recess 112. Moreover, when a given end of passage 98 or 100 is in such fluid communication with recess 112 (the particular passage 98 or 100 being dependent upon the positioning of piston 84 within the second chamber 114), the remaining passage 98 or 100 will not be in such fluid communication.

For example, in FIG. 2, pressurized fluid entering port 96 and recess 112 will be communicated through passage 98 to the volume between the vibrator body 42 and the lower end of piston 84 thereby causing the piston 84 to move in a generally upward direction. When the piston 84 has moved sufficiently upward, the termination of passage 98 will be cut off from fluid communication with recess 112 whereas the termination of passage 100 intermediate the ends of piston 84 will thereby be moved into fluid communication with recess 112, whereby this pressurizing fluid entering port 96 will thence be communicated to the volume above the piston 84 between its upper end and the cap 90 thereby forcing the piston back downward. Thus, it will be appreciated that by an appropriate selection of recess 112 and passage 98–100 locations and dimensions as well as piston 84 dimensions, weight, and appropriate selection of pressurizing fluid entering port 96, the piston 84 may be caused to vibrate or oscillate in the longitudinal direction of axis 91 delivering an impacting force from the piston base 108 to the upper anvil surface 110, such selection of dimensions and the like being well known in the art.

Referring now to the lower portion of FIG. 2, the aforementioned mounting means 46 will be seen to have an end portion 111 received by and in mating engagement with the aforementioned first chamber 115. In the embodiment depicted in FIG. 2, the mounting means 46 will take the form of a mount having a tapered bore 88 disposed therein for receiving a mating tapered end of a rod member 14 such as that depicted in FIG. 1. Alternatively, the mounting means 46 may take the form of a face plate such a the mounting plate member 117 depicted in phantom in FIG. 2. In the latter form, the mounting plate member 117 may be bolted or welded directly onto the surface to be vibrated in a manner well known in the art unlike the case wherein the mounting means 46 is adapted to receive the rod member 14 whereby the rod member 14 delivers vibration of the vibrating means previously described to the article to be vibrated such as the anvil 18 and precipitator plates 20 of FIG. 1.

It will be noted that a hydraulic fitting 53 may also be included for providing fluid commnunication between the tapered bore 88 and a source of pressurized fluid outside the vibrator assembly 80. It will be recalled that once the vibrator assembly 80 is installed upon the rod member 14, the press fit between the rod member 14 and mounting means 46 becomes extremely tight rendering it difficult to remove the vibrator assembly 80 from the rod member 14 for repairs or the like. Thus, the purpose of the hydraulic fitting 53 is to provide a convenient means whereby the portion of the tapered bore 88 between the tapered end 14 and the mounting means 46 may have a pressurized fluid injected therein to assist in separation of the mounting means 46 from the rod member 14. It will also be noted that in the embodiment depicted in FIG. 2, the cap 90, vibrator body 42, piston 84, mounting means 46, and rod member 14 will all preferably be coaligned along the longitudinal axis 91 as therein depicted.

Referring now to the retainer means 113 for retaining the mounting means 46 within the vibrator body 42, it will be recalled that the vibrator assembly 80 has a tendency to torque in the direction of the arrow 13 of FIG. 1 about the axis 91 (in addition to providing the desired impacting force in the direction of axis 91), such torque or twisting action being thought to arise from a force component introduced to the vibrator assembly from the hydraulic line interconnected to the port 96. It will further be recalled that such a twisting action has been found to be extremely undesirable and troublesome in the industry in causing shearing of the rod member 14 or the bolts 32 in the case of a two piece vibrator assembly construction of FIG. 1, or other damage.

Thus, in accordance with the teachings of the present invention, the retainer means 113 is provided for not only retaining the end portion 111 of mounting means 46 within the first chamber 115, but further for permitting relative rotation between the vibrator body 42 and the mounting means 46 about the axis 91 whereby such tendency of the vibrator body 42 to rotate will not be transmitted significantly to the mounting means 46 and thereafter to either the rod member 14 or the article bolted or attached to mounting plate member 117.

In the embodiment depicted in FIG. 2, the retainer means will take the form of an aperture extending through the vibrator body 42 and terminating in a first recess, a second recess in the form of a groove circumferentially disposed on the outer surface of the end portion 111 about the axis 91 and a plurality of balls of the ball bearing type or the like 102. Additionally, a convenient means for insuring that the balls are retained in the first and second recesses such as the plug and ring assembly 104 may be provided. It will be appreciated that various alternative retainer means 113 may be provided to achieve the desired result to be hereinafter described. However, for the present purposes it will be understood that in the arrangement depicted in FIG. 4, the retainer means 113 will thus prevent relative movement between the vibrator body 42 and the mounting means 46 in the direction of axis 91 while permitting their relative motion about axis 91 as desired, the balls 102 and their respective recesses or races serving in a ball bearing fashion to permit such rotational movement.

With respect to the preferred embodiment depicted in FIG. 3, the assembly is substantially identical to that of FIG. 4 with the exceptions to be hereinafter noted. Thus, a vibrator assembly 40 is provided again comprised of an appropriate vibrator means for providing the impacting force and a mounting means 46 as well as an appropriate retainer means 113 for interconnecting the mounting means 46 and the vibrator means in the previously described manner whereby relative linear and rotational motion between the mounting means 46 and the vibrator means is restricted and permitted, respectively.

Figure 3:
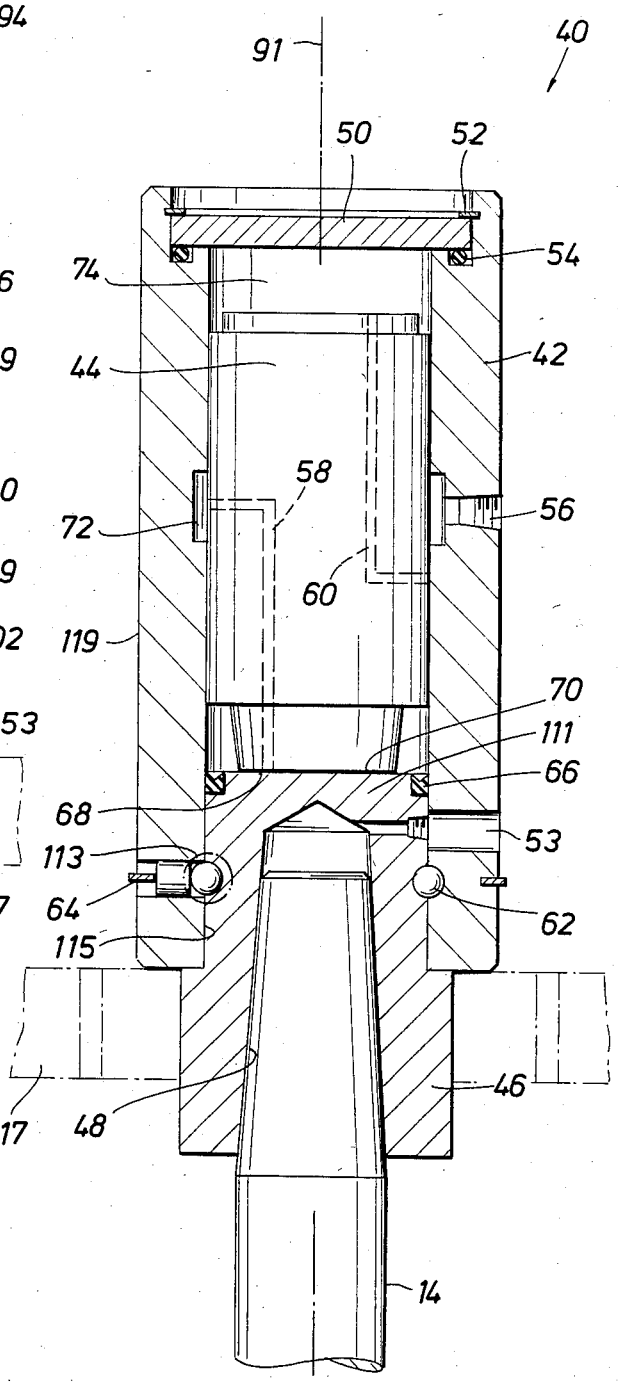
FIG. 3 is a side view, partially in section, of another embodiment of the vibrator assembly of the present invention.

Referring more particularly to FIG. 3, a vibrator body 42 is provided again having machined therethrough an annulus 74 sealed at one end by cap 50, cap retainer 52, and cap seal 54. Again, a piston 44 is disposed within the annulus 74 having the aforementioned passages 58 and 60 disposed therethrough. Further, a recess 72 in the inner wall surface of vibrator body 42 is provided in fluid communication with an appropriate hydraulic fluid connector terminal report 56.

Referring now to the lower portion of FIG. 3, the significant difference over the embodiment depicted in FIG. 2 may be seen more clearly. More particularly, it will be noted that the anvil 109 and the division thereby of the annulus into separate chamber 115 and 114 have been omitted, thereby causing the piston base 68 of piston 44 to contact a mounting base 70 surface of the mounting means 46 directly. Because the anvil 109 is thus not provided for sealing off the lower portion of the annulus 74, it is desirable to provide a mounting seal 66 for maintaining pressure within the annulus 74 and thereby preventing leakage between the mounting means 46 and the inner wall surface of the vibrator body 42. Again, the mounting means 46 may preferably be provided with a tapered bore 48 for receiving in mating engagement a tapered end of rod 14 or, in the alternative, the mounting means 46 may include a mounting plate member 117 (shown in phantom) for direct interconnection to the article to be vibrated as hereinbefore noted. Also, a hydraulic fitting 53 may be provided with an appropriate passageway to the tapered bore 48 also for purposes hereinbefore noted in assisting in the removal of rod 14 from mounting means 46.

Finally, and also in like manner to the embodiment depicted in FIG. 2, an appropriate retainer means 113 may be provided for retaining the end portion 111 of the mounting means 46 within the annulus 74 while at the same time permitting relative rotational movement between the mounting means 46 and vibrator body 42 about the axis 91. Whereas the retainer means 113 of the embodiment of FIG. 3 is identical to that of FIG. 2 (e.g., it includes an aperture for inserting balls 62 therein whereby they may be disposed in a first recess in vibrator body 42 and a groove-like circumferential second recess about the outer surface of end portion 111 and the balls 62 may further be retained therein by means of the assembly 64), the invention admits of variations in the form and structure of retainer means 113.

With respect to the embodiment depicted in FIG. 3, it has been found that significant advantages are achieved thereby not only in reducing the torsional forces heretofore introduced into the article to be vibrated or its attendant mounting means or connections, but additionally it has been found that the vibrator assembly constructed in accordance with the hereinbefore noted description with reference to FIG. 3 provides a much more efficient vibrator assembly. More particularly, it has been found that by transmitting the impacting force from the piston 44 directly to the mounting means 46 and thereafter to the article to be vibrated (either rod 14 or the article bolted or otherwise attached to mounting plate member 117) a greater magnitude of such impacting force may be delivered directly to the article from the piston 44. In other words, the large amount of force previously lost to the vibrator body 42 from the piston 44 (due to the piston 84, as in FIG. 2, first contacting the anvil 109 of the vibrator body 42) has been avoided.

Referring now to FIGS. 4A–4F, there will be seen depicted therein alterate embodiments of portions of the present invention adaptable to either configurations of FIGS. 2 or 3. More particularly alternate retainer means are depicted for interconnecting the mounting means to the vibrator body whereby the desired relative rotational alignment between the vibrator body and the mounting means may be achieved while at the same time retaining the vibrator body interconnected to the mounting means. These embodiments also may permit maximum transfer of energy from the piston to the mounting means to minimize loss thereof into the vibrator body inasmuch as the piston (not shown) may be permitted to contact mounting means 46 directly.

FIGS. 4A and 4B are side and top views, in section, respectively, depicting a vibrator body 42 and mounting means 46 of the present invention as well as one form of the retainer means 113 hereinbefore described.

With respect to the embodiment of FIGS. 4A and 4B, it will be noted that a first recess 126 may be provided internally of housing 42 which may, in this embodiment, take the form of an arcuate groove disposed about axis 91. In like manner, a second recess 126A may be provided in the outer surface of the end portion of mounting means 46 which is disposed within annulus 74. In like manner to first recess 126, the second recess 126A may take the form of an arcuate groove also disposed about axis 91. When the end portion 111 is properly coaxially aligned along axis 91 with respect to vibrator body 42, the first and second recesses 126 and 126A will be seen to matingly align in registry as shown in FIG. 4A to define a hollow torroidal chamber about axis 91 and lying in a plane intersected by axis 91.

An aperture 129 is provided extending through the vibrator body 42 and interconnected to the first recess 126 whereby a retainer member 128 (which in the embodiment of FIGS. 4A and 4B may take the form of an elongate flexible wire) may be inserted from a location outwards of the valve body 42 through the aperture 129 and into the aforementioned torroidal chamber defined by first and second recesses 126 and 126A, said wire flexing as it is introduced into the aperture 129 until it assumes the shape depicted in FIG. 4B in mating engagement with the first and second recesses 126 and 126A.

It will thereby be appreciated that in the embodiment just described, the vibrator body 42 and mounting means 46 may thus be permitted to rotate relative to one another about axis 91 in the desired manner. Moreover, the piston 44 (not shown) may also be permitted to contact the end portion 111 of the mounting member 46 directly thereby increasing the magnitude of impacting force transmitted from the piston to the article to be vibrated by reducing the energy loss from the piston to the vibrator body 42 itself.

Referring now to FIG. 4C, yet another alternate embodiment of the retainer means 113 will be seen. In this embodiment, again a first recess 126 may be provided in the vibrator body 42 and a second recess 126A in the end portion 111 of the mounting means 146. Also, in like manner to the previously described embodiment, these recesses may be brought into mating engagement upon appropriate coaxial alignment between the vibrator body 42 and mounting member 46 as shown in FIG. 4C. Also, an aperture 129 extending through the vibrator body 42 and interconnected to first recess 126 will permit insertion of a retainer member 132 which, in this case, may take the form of an elongate rigid pin into the aperture 129 and subsequently into recesses 126 and 126A. In the embodiment of FIG. 4C, recess 126 may simply be the radially inwardmost portion of the cylindrical aperture 129 and the second recess 126A may take the form of an arcuate slot or groove extending at least partially about the outer surface of the end portion 111 and about the axis 91. In this manner, again, the retainer member pin 129, while held captive by the aperture 129 will have its radially inwardmost end thereof travelling in the race defined by the second recess 126 as the vibrator body 42 and mounting means 46 rotate relative to one another about axis 91.

FIG. 4D simply depicts an alternative arrangement of the embodiment depicted in FIG. 4C wherein in lieu of the pin 132, an appropriate retainer member screw 136 or 136A is provided in mating engagement with threads provided in aperture 129 so as to retain these retainer members 136 or 136A in the appropriate position.

FIGS. 4E and 4F are still another alternate embodiment of the present invention showing, in section, a side view and top view, respectively, of the vibrator body 42, mounting means 46, and retainer means 113 of the present invention, similar to the views depicted in FIGS. 4A and 4B.

With respect to FIG. 4E, first recess grooves 126 are provided in the vibrator body 42 and second recess grooves 126A provided in the end portion 111 of mounting means 46. However, with respect to FIG. 4F, it will be noted that these first recesses 126, in this embodiment, may take the form of four such recessed grooves in the internal surface of vibrator body 42 disposed at 90° angles relative to axis 91, and that each such groove 126 may be provided with an aperture 129 in communication therewith. In like manner, the second recess 126A disposed on the outer surface of end portion 111 may also take the form of a groove lying in a plane disposed at a 90° angle to axis 91. Still further, in like manner to the previously described embodiments, upon appropriate coaxial alignment of vibrator body 42 and mounting means 46 whereby the first and second recesses 126 and 126A are brought into opposed mating alignment, a plurality of retainer members 140 taking the form of pins may be inserted through their respective apertures 129 and into the cylindrical cavity formed by the mating alignment of first and second recess grooves 126 and 126A whereby, again, substantial relative motion between vibrator body 42 and mounting member 46 in the longitudinal axis 91 is thereby restricted while permitting relative rotational movement therebetween. In this embodiment, it will be appreciated that radially inward portions of the pins 129 will extend into the second recess 126A and will travel along the respective recesses 126A as the vibrator body 42 and mounting means 46 are relatively rotated.

It is therefore apparent that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape and material composition of its components, as well as in the details of the illustrated construction, without departing from the scope and spirit thereof.

What is claimed is:

1. A vibrator assembly for imparting a periodic impacting force to an article to be vibrated, comprising:

vibrator means defining an annulus therein for generating said force along the longitudinal axis of said vibrator means in response to pressurized fluid introduced into said vibrator means;

mounting means interconnected between said vibrator means and said article and including an end portion extending into said annulus for transmitting said force from said vibrator means to said article said mounting means defining a circular area transverse to and including said longitudinal axis through which said force is transmitted; and retainer means interconnecting said vibrator means and said mounting means for permitting rotational motion of said vibrator means relative to said mounting means about said axis while restricting relative motion between said mounting means and said vibrator means in the direction of said axis.

2. Apparatus of claim 1, wherein said vibrator means includes a piston movable within said annulus and along said axis in response to said fluid and having a piston base intersected by said axis; and said end portion of said mounting means defining a mounting base intersected by said axis and matingly engagable with said piston base.

3. Apparatus of claim 1, wherein said vibrator means includes an anvil dividing said annulus into first and second chambers;

said mounting means includes an end portion extending in mating engagement with said vibrator means into said first chamber; and wherein said retainer means interconnects said body and said end portion.

4. Apparatus of claim 3, wherein said vibrator means includes a piston movable within said second chamber along said axis in response to said fluid and wherein said piston includes a piston base intersected by said axis;

said anvil defining an upper anvil surface intersected by said axis and engagable with said piston base.

5. Apparatus of claim 2, wherein said mounting means includes a mounting plate member attached to said article.

6. Apparatus of claim 2, wherein said mounting means includes a tapered bore adapted to matingly receive a tapered end of a rod member interconnected between said mounting means and said article.

7. Apparatus of claim 4, wherein said interconnection of said retainer means between said vibrator means and said mounting means is releasable whereby said vibrator means is thereby movable along said axis relative to said mounting means.

8. A vibrator assembly for imparting a periodic impacting force to an article, comprising:

a vibrator body defining an annulus therethrough and having a longitudinal axis;

a piston member movably disposed along said axis within said annulus and having a piston base;

a mount means partially disposed within and sealing off said annulus, said mount having a circular base transverse to said axis engagable with said piston base for transferring momentum from said piston member through said mount means to said article;

a cap carried by said vibrator body and sealing off said annulus; and retainer means for retaining said mount partially within said annulus while permitting rotational movement of said mount relative to said body about said axis.

9. Apparatus of claim 8, wherein said retainer means comprises:

a first recess in said body;

a second recess in said mount aligned with said first recess when said mount is partially disposed within said annulus; and a retainer member disposed in a position within said first and second recesses.

10. Apparatus of claim 9, wherein said first or second recesses comprises an arcuate groove extending at least partially about said axis.

11. Apparatus of claim 10, wherein said body has an outer surface and further defines an aperture extending through said body from said first recess to said outer surface for guiding said retainer member from a location radially outwards of said outer surface through said aperture and into said position within said first and second recesses.

12. Apparatus of claim 11, wherein said retainer member comprises a plurality of balls; and said vibrator assembly further includes means removably disposed within said aperture for preventing movement of said plurality of balls radially outward along said aperture to said location.

13. Apparatus of claim 11, wherein said retainer member comprises an elongate pin.

14. Apparatus of claim 11, wherein said aperture defines a threaded surface and said retainer member comprises a screw threadedly received by said aperture.

15. Apparatus of claim 11, wherein said retainer member comprises a flexible wire introducible through said aperture to form an arcuate shape about said axis and in mating engagement with said arcuate groove.

16. Apparatus of claim 11, wherein said mount includes a tapered bore adapted to matingly receive a tapered end of a rod member interconnected between said mount and said article.

17. Apparatus of claim 11, wherein said mount includes a mounting plate member attached to said article.

* * * * *